United States Patent [19]

Burk et al.

[11] Patent Number: 4,890,465

[45] Date of Patent: Jan. 2, 1990

[54] TANG CLUTCH FOR PLANETARY AUTOMATIC WASHER DRIVE

[75] Inventors: Jeffrey L. Burk, Lincoln Township, Berrien County; Douglas E. Wood, Hagar Township, Berrien County, both of Mich.

[73] Assignee: Whirlpool Corporation, Benton Harbor, Mich.

[21] Appl. No.: 204,228

[22] Filed: Jun. 9, 1988

[51] Int. Cl.[4] ..... D06F 37/40

[52] U.S. Cl. ..... 68/23.7; 464/160

[58] Field of Search ..... 68/23.7; 464/160

[56] References Cited

U.S. PATENT DOCUMENTS 2,301,046 11/1942 Henderson ..... 68/23.7
3,209,877 10/1964 Jordan et al. ..... 464/160 X
4,317,343 3/1982 Gerry ..... 68/23.7
4,387,580 6/1983 Kennedy et al. ..... 68/23.7 X
4,563,786 1/1986 Brunswick et al. ..... 68/23.7 X

*Primary Examiner*—Philip R. Coe
*Attorney, Agent, or Firm*—Hill, Van Santen, Steadman & Simpson

[57] ABSTRACT

A clutch mechanism for an automatic washer is provided which permits oscillatory motion of the agitator and results in rotary motion of the basket upon no more than 360° rotation of the agitator. This mechanism is aptly suited for a planetary drive wherein a first tang is carried on a planet carrier connected directly to the agitator and a second tang is carried on ring gear connected directly to a ring gear. Engagement of the two tangs occurs upon sufficient rotary motion of the agitator wherein the basket tang will be picked up by the agitator tang causing the basket to rotate with the agitator.

18 Claims, 3 Drawing Sheets

TANG CLUTCH FOR PLANETARY AUTOMATIC WASHER DRIVE

BACKGROUND OF THE INVENTION

The present invention relates to a clutch for an automatic clothes washer and more particularly to a vertical axis washer having a planetary drive system.

Automatic washers having a direct drive system between the motor and agitator/wash basket require a clutch mechanism so that the washer will be able to operate in an agitate mode wherein the agitator is oscillated while the basket is held stationary, and in a water extraction mode wherein the agitator and basket are spun together. Conventional machines utilizing this drive system incorporate a spring clutch or a spline clutch with a solenoid to actuate the clutch, moving the clutch member vertically on the motor shaft to selectively engage or disengage a connection with the basket. This spline clutch and solenoid represent a fairly expensive mechanism and it would be an improvement in the art if a less expensive arrangement were provided which would nevertheless provide the necessary clutch function of shifting between the agitate mode and the spin mode.

SUMMARY OF THE INVENTION

The present invention provides a clutch for a planetary drive system in which a pair of opposed tangs are positioned to engage upon a sufficient relative rotation of two parts of the planetary gear housing. One tang depends from the brake drum and/or spin tube which connects directly to the basket and the other tang is mounted on the carrier plate for the planetary gears. The motor is operably connected to the sun gear which drives the planet gears and associated carrier plate which in turn is connected directly to the agitator.

During the agitate cycle, the tang on the carrier plate will normally avoid contact with the tang depending from the brake drum since the carrier plate usually rotates less than 360°. During the spin cycle, the input to the sun gear is continuous in a clockwise direction and thus the tang on the carrier plate will engage and pick up the tang on the brake drum. The basket is then driven through the sun gear/carrier plate which is pushing against the tang on the brake drum.

To minimize noise due to impact, impact deadening materials can be added to either or both tangs. Also, by controlling the angular position and the angular direction at which the agitator stops and starts, the distance between the tangs can be controlled to minimize the numbers of impacts during spin cycle start-up. Another technique for reducing impacts at start-up for spin is to provide a slow, "soft" start-up speed for the input.

If the two tangs should "bump" into each other during agitation, the gear case housing will be pushed slightly and/or the input motor will momentarily stall and will continue to agitate from the new reference point.

Thus, with the use of the two tangs, the spline clutch and solenoid required in conventional machines can be eliminated.

DETAILED DESCRIPTION OF THE PREFERRED EMBODIMENTS

Figure 1:
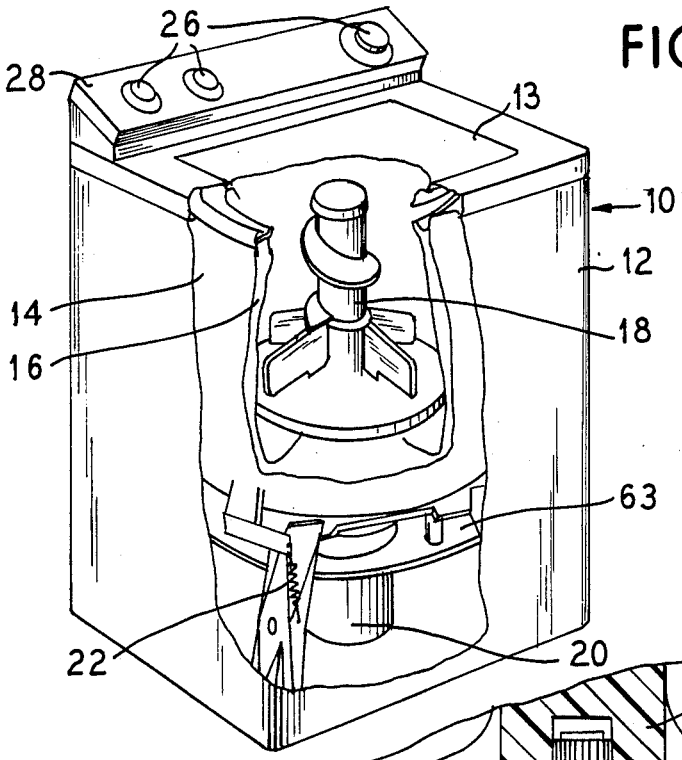
FIG. 1 is a perspective illustration of an automatic washer embodying the principles of the present invention.

In FIG. 1 there is illustrated an automatic washer generally at 10 embodying the principles of the present invention. The washer has an outer cabinet 12 with an openable lid 13 which encloses an imperforate wash tub 14 for receiving a supply of wash liquid. Concentrically mounted within the wash tub is a wash basket 16 for receiving a load of materials to be washed and a vertical axis agitator 18. A motor 20 is provided which is drivingly connected to the agitator 18 to drive it in an oscillatory or rotary manner and is also selectively connectable to the basket 16 to rotate it. The assembly of tub, basket, agitator and motor is mounted on a suspension system 22. A plurality of controls 26 are provided on a control console 28 for automatically operating the washer through a series of washing, rinsing and liquid extracting steps.

Figure 2:
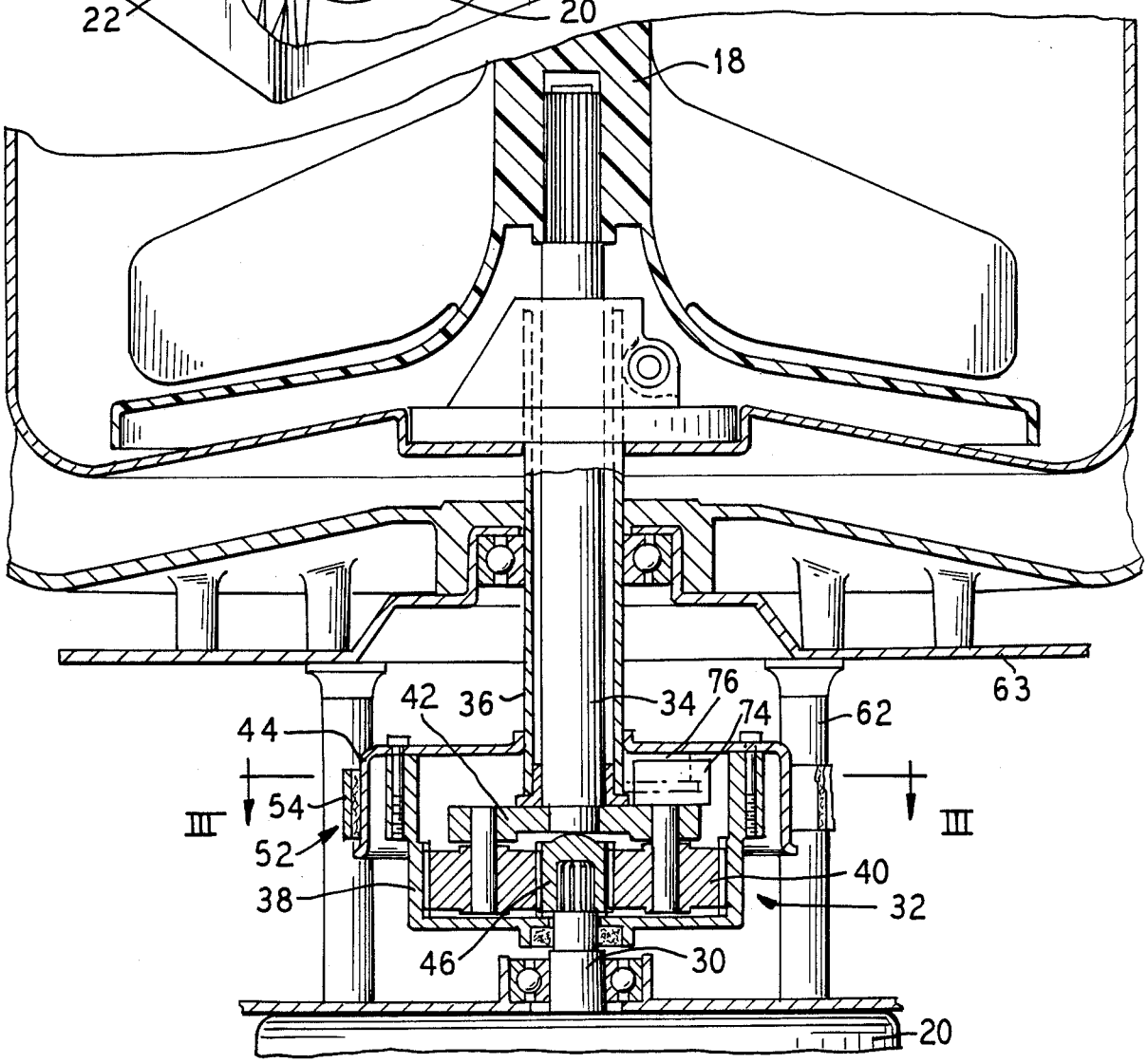
FIG. 2 is a side sectional view of the agitator and drive system of the washer of FIG. 1.

The drive mechanism is shown in greater detail in FIG. 2 where it is seen that the motor 20 is operably connected to a drive shaft 30 which, through a gear arrangement such as a planetary gear assembly 32, drives a vertical shaft 34 connected to the agitator 18. In this particular drive arrangement, the motor 20 may be a permanent split capacitor (PSC) motor which is to be reversely operated to provide the oscillatory motion to the agitator and basket. The motor 20 may be directly connected to the drive shaft 30 or connected through a belt system, not shown. The wash basket 16 is connected via a spin tube 36 to an outer ring gear 38 of the gear arrangement 32 having an external generally cylindrical hub surface 44. The vertical shaft 34 is connected to planet gears 40 through the use of a connecting carrier plate 42. A sun gear 46 is directly connected to the drive shaft 30.

When the washer is operating in the agitate mode, the motor 20 is operated in a reversing fashion which causes the drive shaft 30 to oscillate, thus driving the sun gear 46 in alternating opposite directions. The agitator 18 is therefore oscillated through its connection with the planet gears 40. The wash basket is preferably held stationary while the agitator is oscillated, for example by means of a band brake mechanism 52 shown best in FIGS. 3 and 5. In the preferred embodiment, the band brake mechanism 52 consists of a brake band 54 having a high friction interior lining 56 which is engageable with at least a portion of the circumference of the hub 44 connected to the basket 16. A first end 58 of the band 54 is pivotally connected to a post 62 forming a part of a frame 63 of the washer. A second end 64 of the band 54 is pivotally connected to a pivot bracket or crank 66 which is also pivotally mounted on the post 62.

Figure 3:
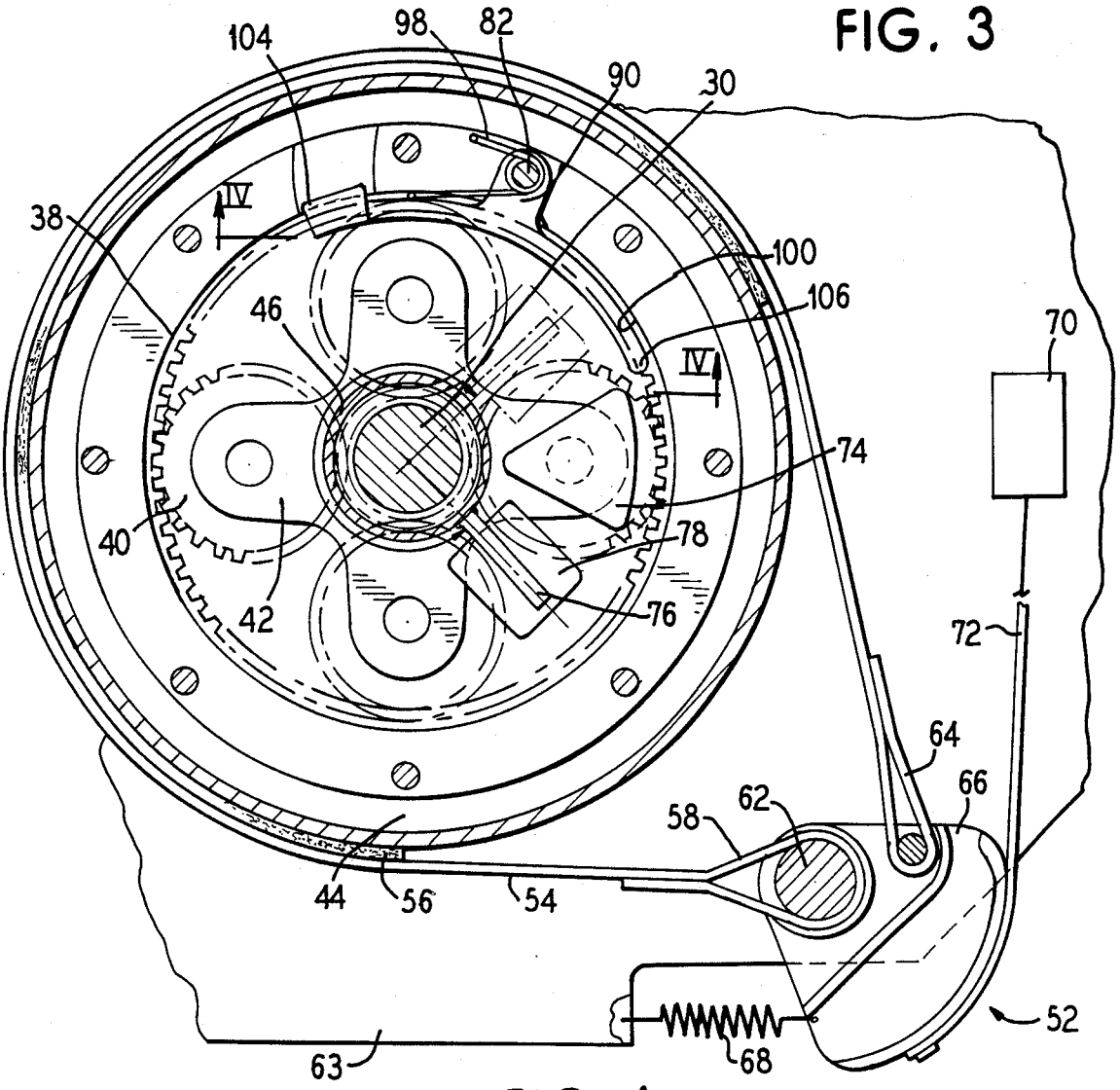
FIG. 3 is a sectional view taken generally along the line III—III of FIG. 2.

The bracket 66 is connected by means of a spring 68 to the frame 63 such that the bracket is continuously urged in a counter-clockwise direction as illustrated in FIG. 3 so that the brake band 54 is held in tight engagement against the hub 44. To overcome the bias of the spring 68 and to place the brake in an off position, a solenoid 70 is provided which is connected by means of a strap 72 to the bracket 66. When the solenoid 70 is energized, the strap 72 is drawn toward the solenoid, rotating the bracket in a counter-clockwise direction on the post 62, thus loosening the brake band 54 on the hub 44.

Generally in the agitate mode, the agitator 18 is oscillated through an angle of approximately 170°-240° during each stroke. Oftentimes it is desireable to hold the wash basket fixed relative to the wash tub during the agitate mode and to do this the brake mechanism 52 is left in an operational condition. However, during the water extraction step, the basket 16 is spun with the agitator 18 and the brake mechanism is released from frictional engagement with the hub 44.

Figure 4:
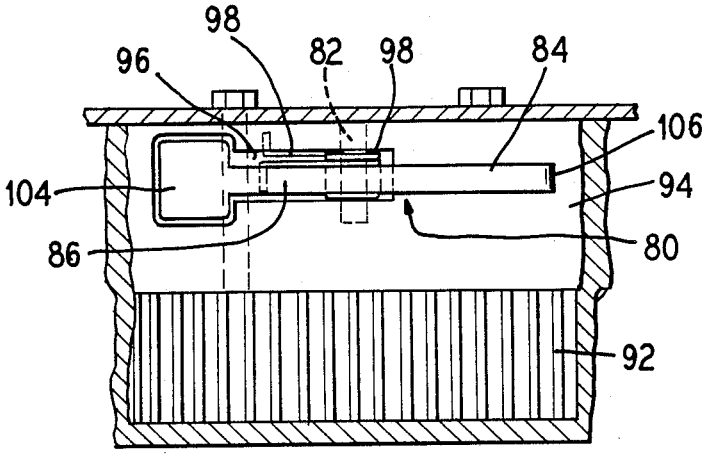
FIG. 4 is a sectional view taken generally along the line IV—IV of FIG. 3.

A clutch mechanism is required to provide means for switching between oscillatory movement of the agitator relative to the basket and spinning of the agitator with the basket. The present invention provides an improved and simplified clutch mechanism, as best shown in FIGS. 3 and 4, comprising a first tang 74 carried on the carrier plate 42 for the planet gears and a second tang 76 depending from the brake hub 44 or spin tube 36. One or both of the tangs can be supplied with a sound deadening material 78 such that engagement of the tangs will not be audibly noticeable.

During the agitate mode, the second tang 76 will be held stationary by the brake mechanism and the first tang 74 will oscillate with the agitator through an angle up to approximately 300°. Normally the two tangs will avoid contact. If the two tangs should engage each other during agitation, the gear case housing 44 may be pushed slightly and/or the input motor 20 may momentarily stall and continue to agitate from a new reference point.

When the washer moves into the spin mode, the first tang 74 on the planet carrier will rotate relative to the brake hub 44 until the tang 74 engages the second tang 76 at which time it will drive the second tang to rotate the hub 44 and thus the basket 16 along with the agitator. During this spin mode the brake mechanism is released so that the basket is free to rotate.

In some instances, it is desireable during the spin mode to periodically energize the motor and then permit it to coast so that the basket is slowly accelerated or is accelerated in steps. In this event, it is desireable to prevent continuous large angle impacts between the tangs. That is, it is desireable to prevent the first tang 74 from backing off away from the second tang 76 during a coasting period and then accelerating the first tang for a period of time before it resumes contact with the second tang.

Figure 5:
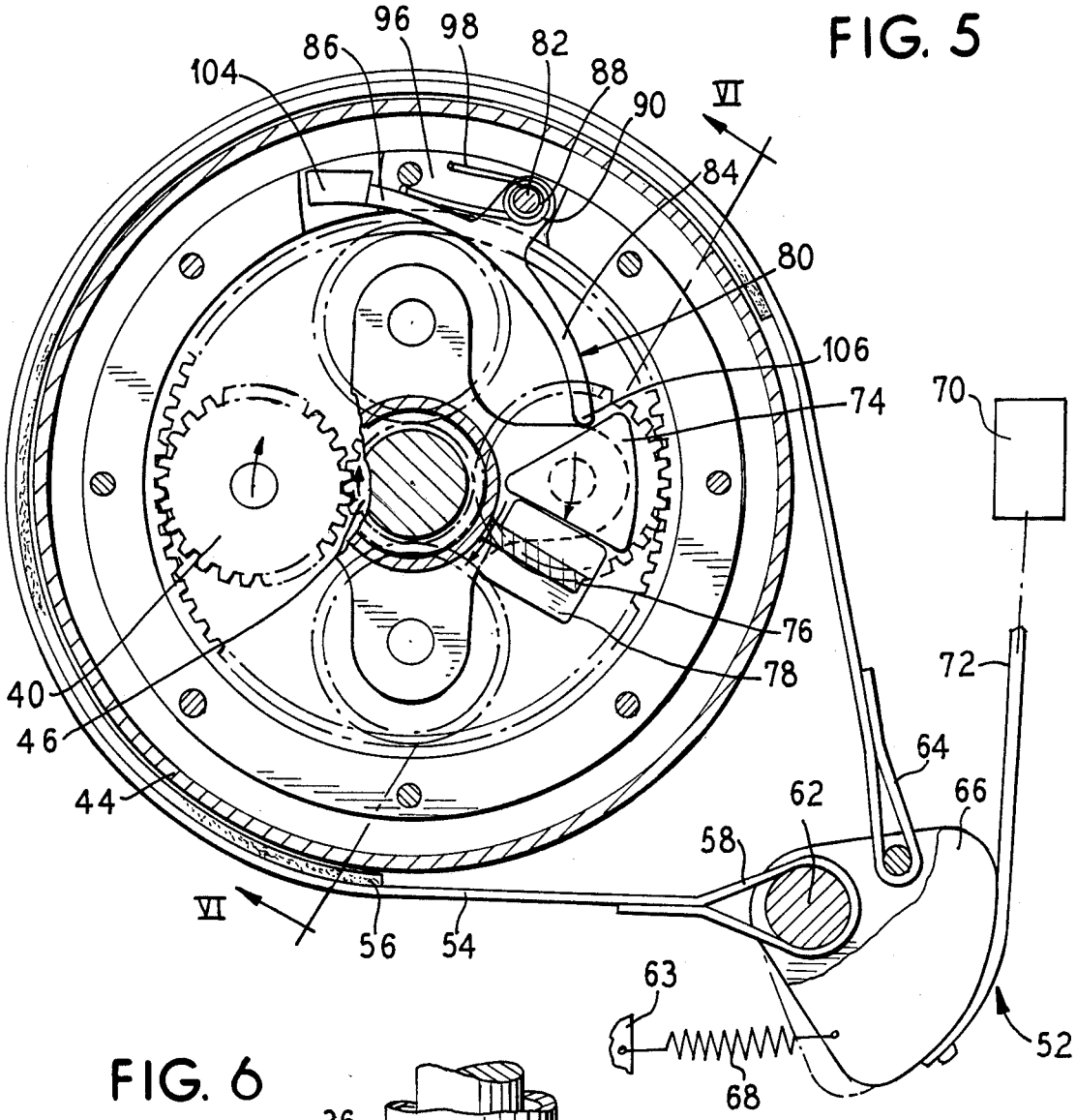
FIG. 5 is a sectional view similar to FIG. 3 illustrating a tang retaining device in the spin mode.

Since the rotation during the spin mode is in the clockwise direction as seen in the view of FIGS. 3 and 5, a coasting would result in a retarding of the speed of the tangs in a clockwise direction and, therefore the first tang 74 might back away from the second tang 76. To prevent the backing away, a spring loaded crank 80 is provided which holds the first tang 74 in place against the second tang 76.

Figure 6:
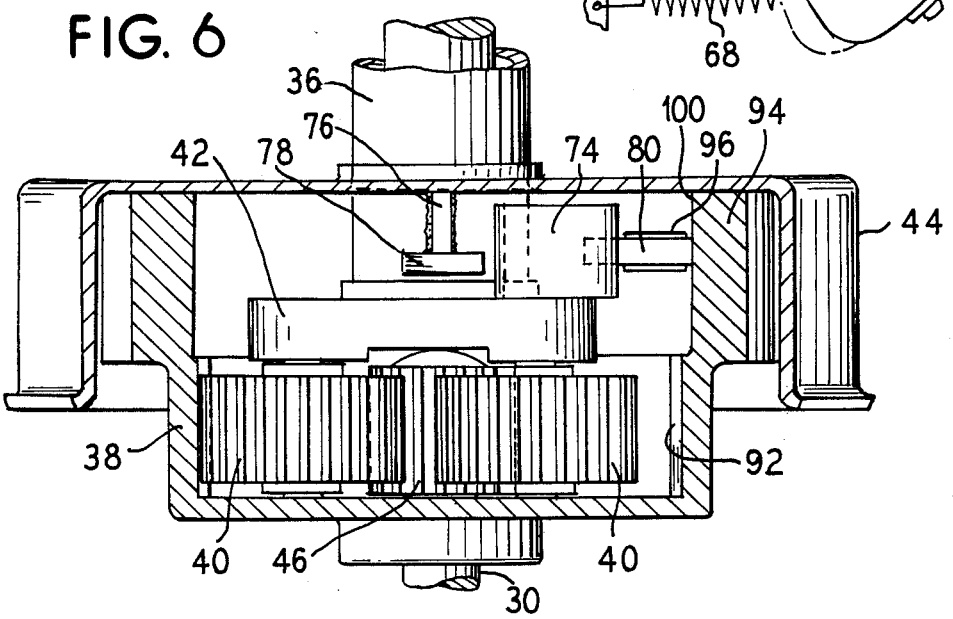
FIG. 6 is a sectional view taken generally along the line VI—VI of FIG. 5.

The crank 80 is pivotally mounted on a post 82 at a central portion thereof and has a first leg portion 84 having an arcuate shape and extending in a clockwise direction from the central portion as seen in FIGS. 3 and 5. The crank 80 has a second leg 86 formed in an arcuate manner and projecting counterclockwise as seen in FIGS. 3 and 5. The pivot post 82 passes through an aperture 88 formed in a radially outwardly projecting tab portion 90 on the crank 80. The ring gear 38 of the planetary drive arrangement has a lower cylindrical section with internal teeth 92 thereon for engaging with the planet gears 40 and, has an upper cylindrical portion 94 at an elevation above the planet gears with a portion above the carrier plate 42 as best seen in FIG. 6. The tab portion 90 of the crank 80 is received in a pocket 96 formed in the upper cylindrical portion 94 and, the pocket 96 is configured such that the second leg 86 of the crank can also be received therein upon a pivoting of the crank. A spring 98 is carried on the post 82 and engages the second end 86 of the crank to urge it inwardly as seen in FIG. 3 so that the first leg 84 will lie against an inside surface 100 of the upper portion 94 of the ring gear 38. When the crank is in this position, the tang 74 carried on the carrier plate 42 will have sufficient clearance to pass along side the crank without contacting it.

When the washer shifts into the spin mode and the brake is released, the ring gear 38 will rotate with the carrier plate when the first tang 74 engages and picks up the second tang 76 as illustrated in FIG. 5. As the speed of the ring gear increases, centrifugal force will operate on the crank causing it to pivot on the post since the second leg 86 has an enlarged and more massive end portion 104 which moves outwardly into the pocket 96 against the force of the spring 98. As this occurs, the first leg 80 will move radially inwardly such that a distal end 106 of the first leg will be in close proximity to a surface of the tang 74 to prevent the tang 74 from backing away from its engagement with the second tang 76. Since the second tang 76 is carried on the same structure as the crank 80, the spacial relationship between the second tang 76 and the crank remains fixed and can be selected to provide proper and sufficient spacing for the capture of the first tang 74 therebetween. In this manner, the first tang can automatically be prevented from backing off from the second tang to avoid large and repeated impacts.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows 1. In an automatic washer having a vertical axis agitator, a concentrically mounted wash basket, a motor drivingly connected to said agitator to selectively oscillate and rotate said agitator about said vertical axis, and a clutch mechanism to permit oscillatory motion of said agitator and rotary motion of said agitator and basket, said clutch mechanism comprising:

first engagement means connected to move with said agitator;

second engagement means connected to move with said basket;

said first engagement means being adapted for selective engagement with said second engagement means upon rotation of said agitator to a predetermined angular position relative to said basket;

said first and second engagement means being disposed such that oscillatory motion of said agitator of less than a 360° stroke angle will result in no continuous contact between said first and second engagement means, and rotary motion of said agitator will cause engagement of said engagement means and resulting rotary motion of said basket after no more than 360° rotation of said agitator; and means for biasing said first and second engagement means into engagement during rotary motion of said agitator and basket.

2. An automatic washer according to claim 1, wherein said means for biasing said first and second engagement means comprises:

a third engagement means operated by centrifugal force upon rotation of said basket such as to bias said first engagement means and second engagement means into engagement with each other.

3. An automatic washer according to claim 1, including means for holding said basket stationary while said agitator is oscillating.

4. An automatic washer according to claim 3, wherein said means for holding said basket stationary comprises a releasable brake means.

5. An automatic washer according to claim 1, including a planetary drive mechanism having a sun gear, a plurality of planet gears driven by said sun gear, and a planet carrier and a ring gear driven by said sun gear, said motor being operably connected to said planet carrier driven by said plurality of planet gears, and said basket operably connected to said ring gear.

6. In an automatic washer comprising:

a vertical axis agitator;

a concentrically mounted wash basket;

a motor drivingly connected to said agitator to selectively oscillate and rotate said agitator about said vertical axis;

a planetary drive mechanism having a sun gear, a plurality of planet gears driven by said sun gear, and a planet carrier and a ring gear driven by said sun gear, said motor being operably connected to said sun gear, said agitator being operably connected to said planet carrier driven by said plurality of planet gears, and said basket operably connected to said ring gear; and a clutch mechanism to permit oscillatory motion of said agitator and rotary motion of said agitator and basket, said clutch mechanism comprising:

first engagement means carried on said planet carrier and connected to move with said agitator; and second engagement means carried on said ring gear and connected to move with said basket; said second engagement means adapted for selective engagement with said first engagement means upon rotation of said agitator to a predetermined angular position relative to said basket; said first and second engagement means being disposed such that oscillatory motion of said agitator of less than a 360° stroke angle will result in no continuous contact between said first and second engagement means, and rotary motion of said agitator will cause engagement of said engagement means and resulting rotary motion of said basket after not more than 360° rotation of said agitator.

7. An automatic washer according to claim 6, further comprising means for biasing said first and second engagement means into engagement during rotary movement of said basket.

8. An automatic washer according to claim 7, wherein said means for biasing said first and second engagement means into engagement comprises:

a third engagement means operated by centrifugal force upon rotation of said basket such as to bias said first engagement means and second engagement means into engagement with each other.

9. An automatic washer according to claim 1, wherein a sound deadening material is applied to at least one of said engagement means so that a sound level of impact of said engagement means is reduced.

10. A clutch mechanism for an automatic washer having a wash basket, a vertical axis agitator within said wash basket, a motor drivingly connected to said agitator to selectively rotate and oscillate said agitator about said vertical axis, said clutch mechanism comprising:

a first tang connected to move with said agitator;

a second tang connected to move with said basket;

said first and second tangs being mounted so as to engage at a predetermined relative angular position of said agitator and basket, such that oscillatory motion of said agitator of less than a 360° stroke angle will generally result in no continuous contact between said tangs, while rotary motion of said agitator will cause engagement of said tags and resulting rotary motion of said basket after no more than 360° rotation of said agitator;

means for biasing said first and second tangs into engagement during rotary motion of said agitator and basket.

11. A clutch mechanism according to claim 10, wherein a sound deadening material is applied to at least one of said tangs so that a sound level of impact of said tangs is reduced.

12. In an automatic washer having a vertical axis agitator, a concentrically mounted wash basket, a motor drivingly connected to said agitator to selectively oscillate and rotate said agitator about said vertical axis, and a clutch mechanism to permit oscillatory motion of said agitator and rotary motion of said agitator and basket, said clutch mechanism comprising:

a planetary drive mechanism having a sun gear operably connected with said motor, a plurality of planet gears, a planet carrier connected to said plurality of planet gears and operably connected with said agitator, and a ring gear operably connected with said basket;

a first tang mounted on said planet carrier;

a second tang mounted on said ring gear and engageable with said first tang at a predetermined angular position of said ring gear relative to said planet gear, such that oscillatory motion of said agitator of less than 360° stroke angle will generally result in no continuous contact between said tangs, while rotary motion of said agitator will cause engagement of said tangs and resulting rotary motion of said basket after no more than 360° rotation of said agitator means for oscillating said agitator; and means for holding said first tang closely adjacent to said second tang only during rotary movement of said basket.

13. An automatic washer according to claim 12, wherein said means for holding said first and second tangs adjacent each other comprises a mechanism operated by centrifugal force upon rotation of said basket.

14. An automatic washer according to claim 13, wherein said means for holding said first and second tangs comprises a crank carried at a pivot point on said ring gear having a first end engageable with said first tang upon a pivoting of said crank causing said first end to move inwardly, said crank having a second end opposite said pivot point from said first end, said second end being more massive than said first end wherein said second end will pivot outwardly under the influence of centrifugal force when said ring gear rotates.

15. An automatic washer according to claim 14, wherein said crank is normally biased by a spring into a position wherein said first end of said crank is held in an outward position away from a path of said first tang.

16. An automatic washer according to claim 12, including means for holding said basket stationary while said agitator is oscillating.

17. An automatic washer according to claim 16, wherein said means for holding said basket stationary comprises a releasable brake.

18. An automatic washer according to claim 12, wherein a sound deadening material is applied to at least one f said engagement means so that a sound level of impact of said engagement means is reduced.

* * * * *